US006565488B2

(12) United States Patent
Chen

(10) Patent No.: US 6,565,488 B2
(45) Date of Patent: May 20, 2003

(54) EXERCISER FOR EXERCISING BACK AND FEET PORTIONS

(76) Inventor: Paul Chen, P.O. Box 63-99, Taichung (TW), 406

( * ) Notice: Subject to any disclaimer, the term of this patent is extended or adjusted under 35 U.S.C. 154(b) by 245 days.

(21) Appl. No.: 09/728,548

(22) Filed: Nov. 29, 2000

(65) Prior Publication Data

US 2002/0065174 A1 May 30, 2002

(51) Int. Cl.[7] ..... A63B 26/00; A63B 69/08
(52) U.S. Cl. ..... 482/73; 482/140
(58) Field of Search ..... 482/140, 142, 482/95, 96, 121, 122, 129, 92, 130, 72, 73

(56) References Cited

U.S. PATENT DOCUMENTS 5,871,425 A * 2/1999 Gvoich ..... 482/123
5,899,836 A * 5/1999 Chen ..... 482/130
6,258,016 B1 * 7/2001 Kuo ..... 482/121
6,428,450 B1 * 8/2002 Ho et al. ..... 482/130

* cited by examiner

*Primary Examiner*—Stephen R. Crow
(74) *Attorney, Agent, or Firm*—Charles E. Baxley

(57) ABSTRACT

An exerciser includes a base including a seat for supporting a user, a back frame rotatably secured on the base with a pivot axle for supporting the back of the user and for allowing the user to force and to rotate the back frame relative to the base about the pivot axle. A foot support is slidable relative to the base and selectively coupled to the back frame for allowing the back frame and the foot support to be moved in concert with each other. The back frame includes one or more brackets selectively secured to the base and the foot support with fasteners.

11 Claims, 3 Drawing Sheets

EXERCISER FOR EXERCISING BACK AND FEET PORTIONS

BACKGROUND OF THE INVENTION

1. Field of the Invention

The present invention relates to an exerciser, and more particularly to an exerciser for selectively exercising the back portion and/or the feet portions of the users.

2. Description of the Prior Art

The present applicant has developed an exerciser for conducting pulling and stepping exercises and has been filed and issued as U.S. Pat. No. 5,899,836 to Chen. However, the back portion may not be rotated relative to the supporting base for conducting the back portion exercises. In addition, the foot pedal may not be moved to exercise the feet portions of the users.

The present invention has arisen to mitigate and/or obviate the afore-described disadvantages of the conventional exercisers.

SUMMARY OF THE INVENTION

The primary objective of the present invention is to provide an exerciser which may be used for selectively exercising the back portion and/or the feet portions of the users.

In accordance with one aspect of the invention, there is provided an exerciser comprising a base including a seat for supporting a user, a back frame rotatably secured on the base with a pivot axle for supporting a back of the user and for allowing the user to force and to rotate the back frame relative to the base about the pivot axle, a foot support slidable relative to the base and movable away from and toward the base, and means for selectively coupling the back frame to the foot support. The user may use his back portion to force and to rotate the back frame about the pivot axle in order to exercise his back portion of the waist portion. The foot support may be selectively coupled to the back frame for allowing the user to exercise his foot portions. The back frame may be secured to the base and may thus be prevented from being rotated relative to the base, for allowing the user to exercise his foot portions only. The user may sit on the base with a seat or may kneel down on the seat to exercise his foot portions.

A rod is further provided for supporting the foot support. A wheel device may further be attached to the rod for facilitating a movement of the rod. A follower may further be provided for supporting the rod. A device may be used for adjustably securing the rod to the follower.

The adjustably securing means includes a sleeve secured on the follower, the rod is slidably received in the sleeve, and means for selectively securing the rod to the sleeve and for allowing the rod to be adjusted relative to the follower.

A spring biasing device may further be used for biasing the foot support to move the foot support toward the base. The selectively coupling means includes a bracket secured to the back frame for supporting the pivot axle, a lever including a first end pivotally secured to the base with the pivot axle and a second end coupled to the foot support, and means for selectively securing the lever to the bracket.

The selectively securing means includes a fastener engaged through the lever and the bracket to secure the back frame and the lever together. The fastener may also be engaged through the base and the bracket to secure the back frame and the base together.

The back frame includes a bottom portion having a pair of arms provided thereon for supporting the bracket. A spring biasing device may further be provided for biasing the foot support to move the foot support toward the base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
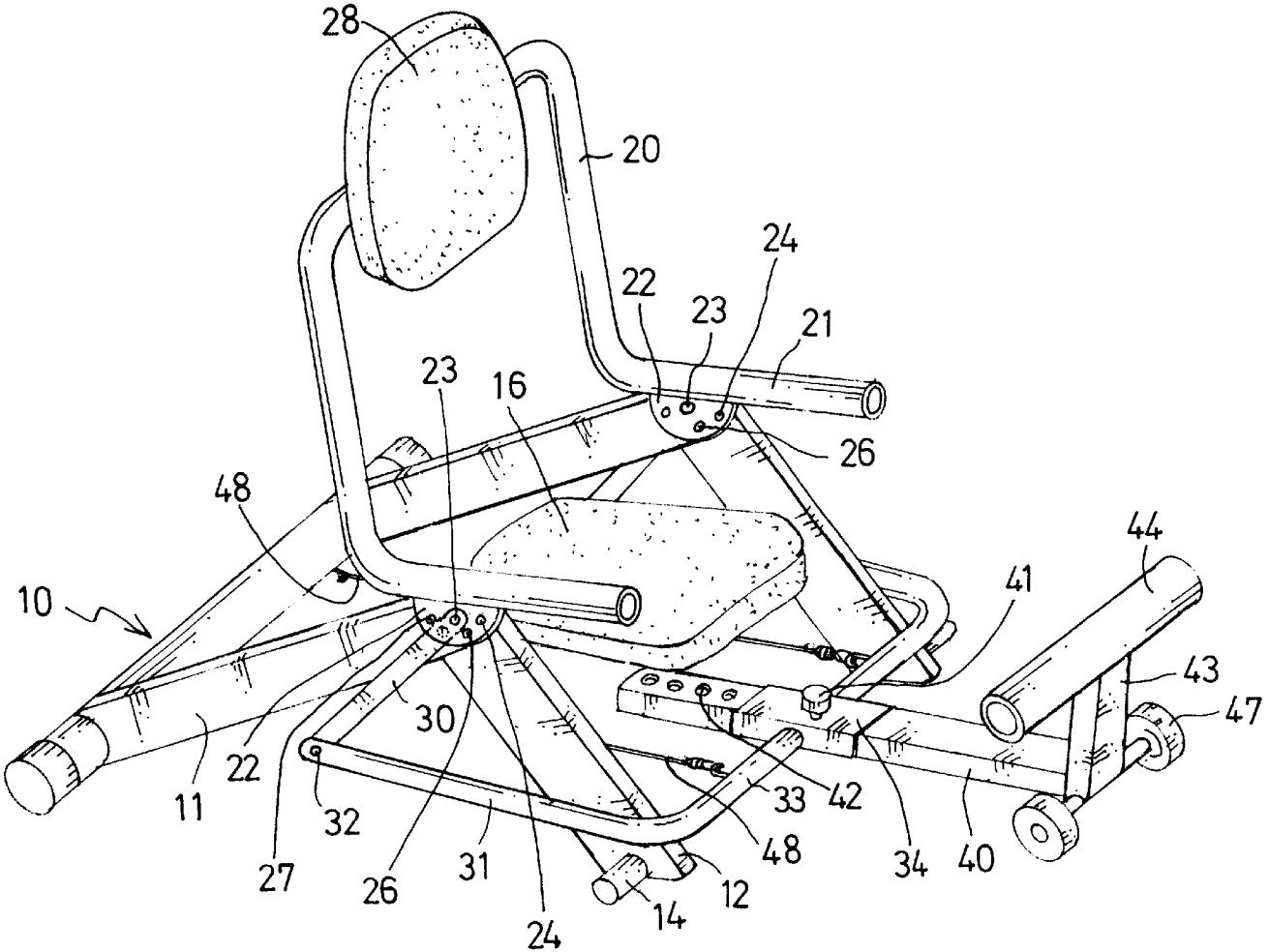
FIG. 1 is a perspective view of an exerciser in accordance with the present invention.
Figure 2:
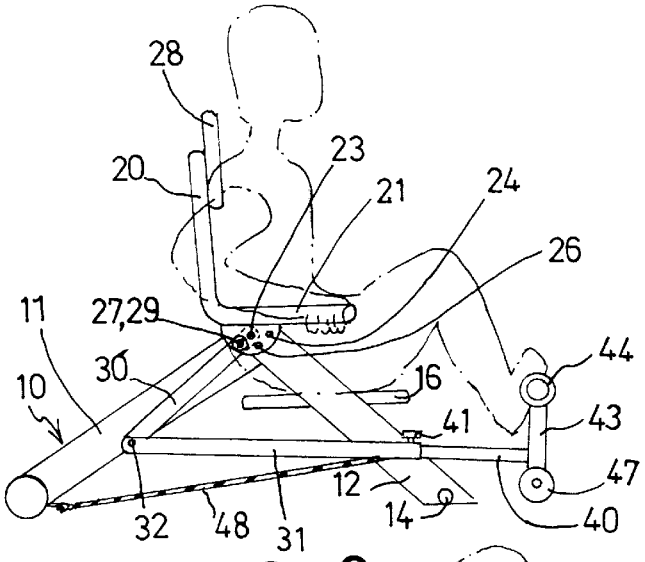
FIGS. 2, 3, 4, 5, 6 are plane schematic views illustrating the operation of the exerciser.

Referring to the drawings, and initially to FIGS. 1 and 2, an exerciser in accordance with the present invention comprises a base 10 including a pair of leg frames 11, 12 secured together for forming an inverted V-shaped configuration. A seat cushion or a seat 16 is disposed on the base 10, such as on top of the leg frames 11, 12 for supporting the buttocks (FIGS. 2–4) or the knees (FIGS. 5, 6) of the users.

A back frame 20 includes a lower portion pivotally secured on the base 10 with a pivot axle 23, for allowing the back frame 20 to be rotated or pivoted relative to the base 10. For example, the back frame 20 includes a pair of arms 21 provided in the bottom portion thereof and parallel to each other for supporting the arms of the users, and includes one or two pairs of brackets 22 secured to the bottom portion of the back frame 20, or secured to the arms 21 respectively, for supporting the pivot axle 23. A pad 28 is secured to the back frame 20 for engaging with the back portion of the users.

A pair of levers 30 each includes an upper end pivotally or rotatably secured to the base 10 with the pivot axle 23, and rotatable relative to the base 10 about the pivot axle 23. A follower 31 includes a rear portion pivotally secured to the levers 30 with pivot pins 32 and includes a front beam 33 for supporting a sleeve 34 thereon. A rod 40 is slidably engaged in the sleeve 34 and selectively or adjustably secured to the sleeve 34 with a fastener 41 or the like. The rod 40 includes a number of orifices 42 formed therein for selectively engaging with the fastener 41 and for adjusting the rod 40 relative to the sleeve 34 and thus to the follower 31. A foot support 44 is secured on the follower 31 or on the rod 40 with a post 43 or the like. A wheel device 47 may be attached to the rod 40 for facilitating the movement of the rod 40 on the floor, or the supporting surface or the like. A spring or a biasing member 48 is coupled between the base 10 and the follower 31 or the rod 40 for applying a biasing force against the follower 31 and thus the rod 40 and the foot support 44.

Figure 3:
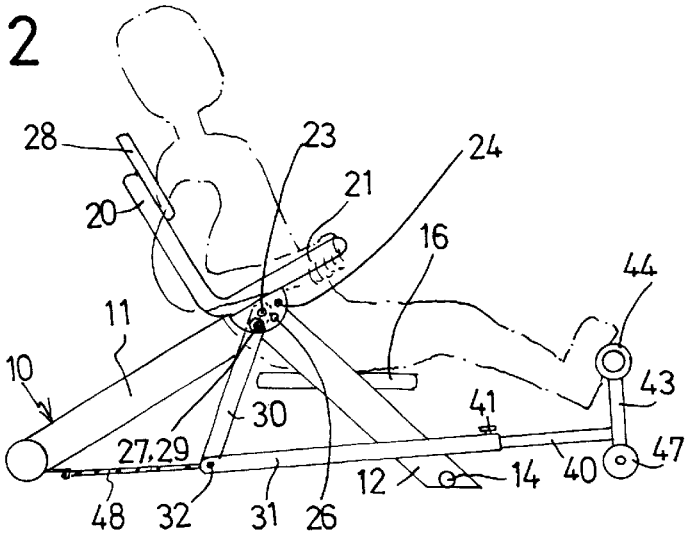

As shown in FIGS. 2 and 3, a fastener 29 may be engaged through an aperture 27 of the bracket 22 and may be engaged through the lever 30 to selectively secure the upper ends of the levers 30 to the brackets 22 and thus to the back frame 20, such that the back frame 20 and the levers 30 rotate in concert with each other. The user may engage his back on the back frame 20 to rotate the back frame 20 about the pivot axle 23 and to exercise his back portion or his waist portion, and may engage his feet on the foot support 44 in order to move the foot support 44 and the rod 40 and the follower 31 forward against the spring or the biasing member 48, and to exercise his feet portion. The biasing member 48 may bias the foot support 44 rearward and may thus bias, via the levers 30, the back frame 20 backward or upward to the erect position as shown in FIG. 2.

Figure 4:
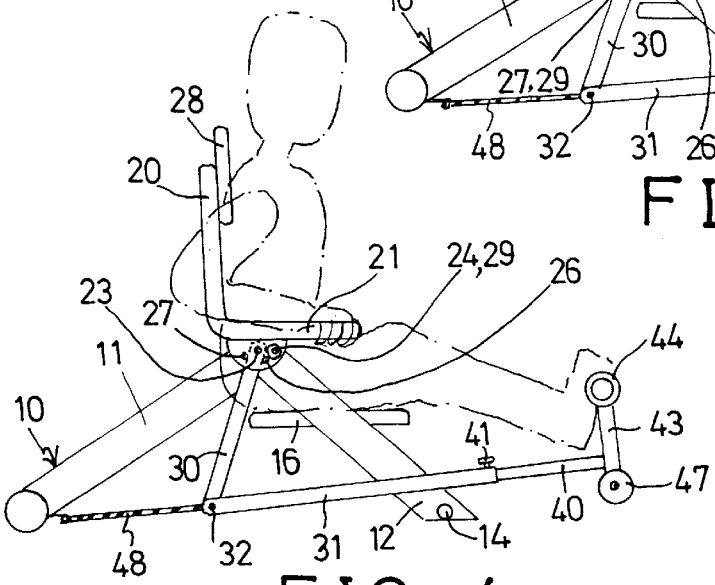

Referring next to FIG. 4, the fastener 29 may be disengaged from the lever(s) 30, and may engage through a hole 24 of the bracket 22 and may engage with the leg frames 11, 12 of the base 10 in order to secure the back frame 20 and the brackets 22 to the base 10. At this moment, the back frame 20 may not be rotated relative to the base 10. The foot support 44 may be moved forward against the spring or the biasing member 48 to exercise the users feet portion.

Figure 5:
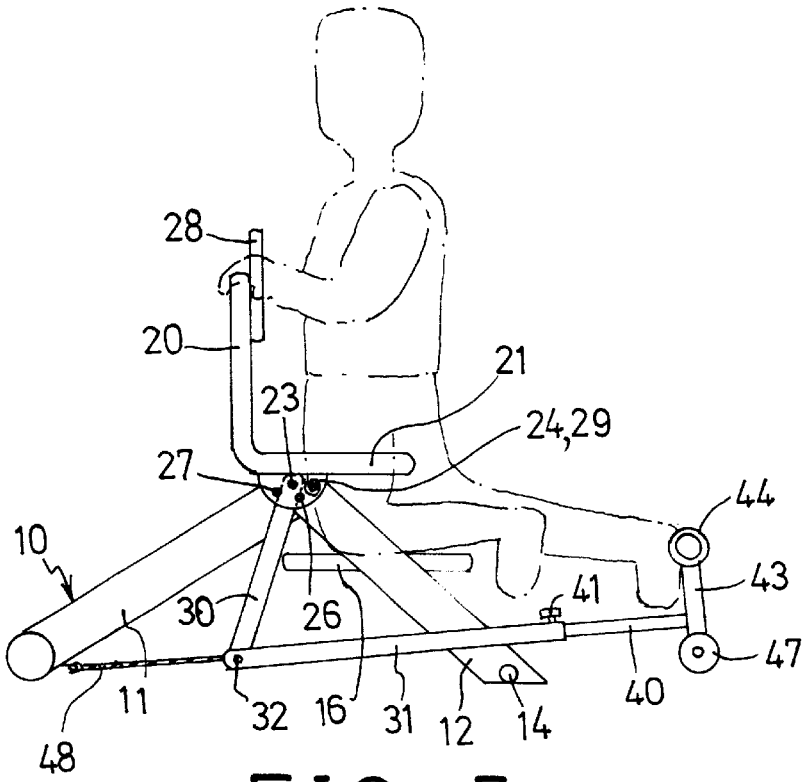

Referring next to FIG. 5, the back frame 20 may still be secured to the base 10 at the upright position. The user may knelt down to engage his knee on the seat 16 and may use his foot or feet to engage with and to move the foot support 44 against the spring or the biasing member 48 in order to exercise the users feet portion.

Figure 6:
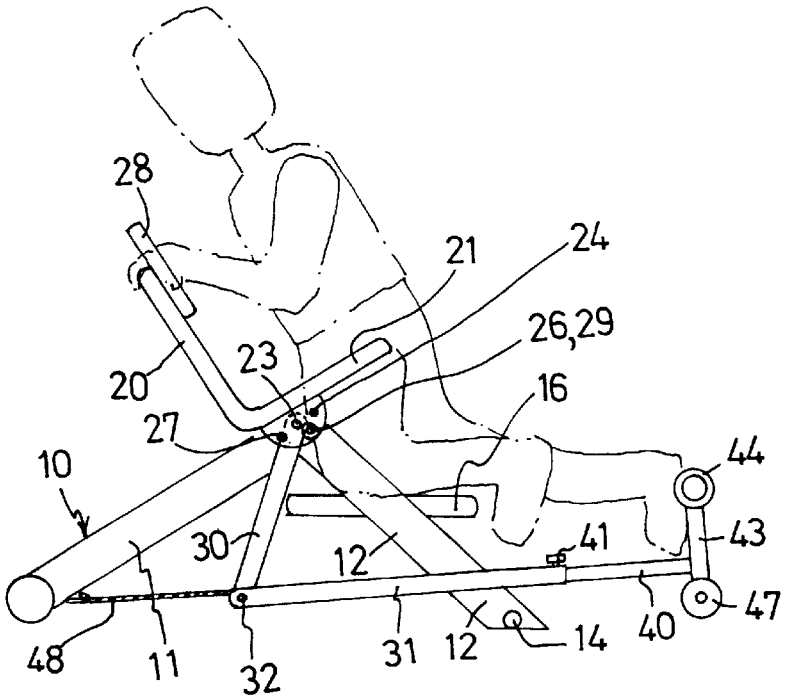

Referring next to FIG. 6, the fastener 29 may be engaged through the other hole 26 for securing the back frame 20 to the base 10 at the tilted position or at an angular position different from that shown in FIG. 5. The back frame 20 is still fixed and secured to the base 10 and may not be rotated relative to the base 10. The foot support 44 may be moved against the spring or the biasing member 48 to exercise the users feet portion.

Accordingly, the exerciser in accordance with the present invention may be used for selectively exercising the back portion and/or the feet portions of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a seat for supporting a user, a back frame rotatably secured on said base with a pivot axle for supporting a back of the user and for allowing the user to force and to rotate said back frame relative to said base about said pivot axle, a foot support slidable relative to said base and movable away from and toward said base, and means for selectively coupling said back frame to said foot support, said selectively coupling means including a bracket secured to said back frame for supporting said pivot axle, a lever including a first end pivotally secured to said base with said pivot axle and a second end coupled to said foot support, and means for selectively securing said lever to said bracket.

2. The exerciser according to claim 1 further comprising a rod for supporting said foot support.

3. The exerciser according to claim 2 further comprising a wheel device attached to said rod for facilitating a movement of said rod.

4. The exerciser according to claim 2 further comprising a follower for supporting said rod.

5. The exerciser according to claim 4 further comprising means for adjustably securing said rod to said follower.

6. The exerciser according to claim 5, wherein said adjustably securing means includes a sleeve secured on said follower, said rod is slidably received in said sleeve, and means for selectively securing said rod to said sleeve.

7. The exerciser according to claim 2 further comprising means for biasing said foot support to move said foot support toward said base.

8. The exerciser according to claim 1, wherein said selectively securing means includes a fastener engaged through said lever and said bracket to secure said back frame and said lever together.

9. The exerciser according to claim 1, wherein said selectively securing means includes a fastener engaged through said base and said bracket to secure said back frame and said base together.

10. The exerciser according to claim 1, wherein said back frame includes a bottom portion having a pair of arms provided thereon for supporting said bracket.

11. The exerciser according to claim 1 further comprising means for biasing said foot support to move said foot support toward said base.

* * * * *